US009550086B1

(12) United States Patent
Poirier

(10) Patent No.: US 9,550,086 B1
(45) Date of Patent: Jan. 24, 2017

(54) EXERCISE APPARATUS

(71) Applicant: Christopher J. Poirier, North Kingstown, RI (US)

(72) Inventor: Christopher J. Poirier, North Kingstown, RI (US)

(73) Assignee: MFAC, LLC, Cranston, RI (US)

( * ) Notice: Subject to any disclaimer, the term of this patent is extended or adjusted under 35 U.S.C. 154(b) by 307 days.

(21) Appl. No.: 14/301,733

(22) Filed: Jun. 11, 2014

(51) Int. Cl.
*A63B 21/00* (2006.01)
*A63B 5/20* (2006.01)

(52) U.S. Cl.
CPC ..... *A63B 5/20* (2013.01)

(58) Field of Classification Search
CPC ..... A63B 21/00
USPC ..... 482/121, 126, 81, 82
See application file for complete search history.

(56) References Cited

U.S. PATENT DOCUMENTS 4,375,886 A * 3/1983 Muys ..... A63B 5/20 482/82
5,205,803 A 4/1993 Zemitis
5,800,322 A * 9/1998 Block ..... A63B 21/0004 482/126
6,202,263 B1 3/2001 Harker
6,402,668 B1 6/2002 Harker
7,175,574 B2 * 2/2007 Carmel ..... A63B 21/0004 482/124
7,503,883 B2 3/2009 Madden
7,628,743 B1 12/2009 Flentye et al.
7,794,374 B1 9/2010 Park
7,819,787 B2 10/2010 Kassel
7,846,078 B1 12/2010 Park
8,168,024 B2 5/2012 Chang et al.
8,529,536 B2 9/2013 Tsang et al.
2002/0052270 A1 * 5/2002 Hinds ..... A63B 21/0004 482/126
2007/0155600 A1 * 7/2007 Cunningham ..... A63B 21/0004 482/126
2013/0310790 A1 11/2013 El Daher et al.
2014/0018765 A1 1/2014 Chang et al.

* cited by examiner

*Primary Examiner* — Jerome W Donnelly
(74) *Attorney, Agent, or Firm* — Salter & Michaelson

(57) ABSTRACT

An exercise apparatus includes an elongated outer elastic hollow tubing having opposed ends and an elongated inner elastic hollow tubing having opposed ends. A connection mechanism at each of the opposed ends is for interlocking the respective opposed ends of the elongated outer elastic hollow tubing and the elongated inner elastic hollow tubing. A pair of handles is positioned at respective opposed ends of the elongated outer and elongated inner elastic hollow tubings.

17 Claims, 12 Drawing Sheets

EXERCISE APPARATUS

FIELD OF THE INVENTION

The present invention relates in general to an exercise apparatus and pertains, more particularly, to an elongated stretchable member preferably having one or more handle ends and used in exercising.

BACKGROUND OF THE INVENTION

Various types of stretchable exercise members are known in the prior art. For the most part these members are comprised of a stretchable band that may have a handle attached to either or both ends thereof. One of the problems associated with the present equipment is that there can be injury to the user should the band all of a sudden break.

Accordingly, it is an object of the present invention to provide an improved exercise apparatus having an elastic band that is comprised of inner and outer tubing. In this way, should the outer tubing break, there is sufficient strength at the inner tubing to maintain the overall band in one piece.

SUMMARY OF THE INVENTION

To accomplish the foregoing and other objects, features and advantages of the present invention there is provided an exercise apparatus that is comprised of an elongated outer tubing having opposed ends and that forms an outer exposed portion of the exercise apparatus; an elongated inner tubing having opposed ends and that forms an inner hidden portion of the exercise apparatus; and a connection mechanism at each of the opposed ends for interlocking the respective opposed ends of the elongated outer tubing and the elongated inner tubing.

In accordance with other aspects of the present invention the elongated outer tubing comprises an elongated outer elastic tubing; the elongated inner tubing comprises an elongated inner elastic tubing; both the elongated outer elastic tubing and the elongated inner elastic tubing are hollow; the connection mechanism is comprised of an outer connection member engaged with an end of the elongated outer elastic tubing; the connection mechanism is also comprised of an inner connection member engaged with an end of the elongated inner elastic tubing; the connection mechanism is comprised of an outer connection member engaged with an end of the elongated outer elastic tubing, and the connection mechanism is also comprised of an inner connection member engaged with an end of the elongated inner elastic tubing; both the outer connection member and the inner connection member are conical for firm engagement with the respective outer and inner elastic tubing; the outer connection member engages an end of the elongated inner elastic tubing at a position adjacent to the inner connection member; the outer connection member is conical for firm engagement with the elongated outer elastic tubing, and the inner connection member comprises a ball engaging within the elongated inner elastic tubing; the conical outer connection member has an inner tapered surface and the elongated inner elastic tubing and ball are captured at the inner tapered surface; in combination with a handle having a securing passage that engages the elongated outer elastic tubing.

In another embodiment of the present invention there is provided an exercise apparatus that is comprised of an elongated outer elastic hollow tubing having opposed ends; an elongated inner elastic hollow tubing having opposed ends; a connection mechanism at each of the opposed ends for interlocking the respective opposed ends of the elongated outer elastic hollow tubing and the elongated inner elastic hollow tubing; and a pair of handles positioned at respective opposed ends of the elongated outer and elongated inner elastic hollow tubings.

In accordance with other aspects of the present invention each handle has a securing passage for receiving an end of the elongated outer elastic hollow tubing; each connection mechanism is comprised of an outer connection member engaged with an end of the elongated outer elastic hollow tubing, and an inner connection member engaged with an end of the elongated inner elastic hollow tubing; both the outer connection member and the inner connection member are conical for firm engagement with the respective outer and inner elastic tubing; the outer connection member engages an end of the elongated inner elastic tubing at a position adjacent to the inner connection member; the outer connection member is conical for firm engagement with the elongated outer elastic tubing, and the inner connection member comprises a ball engaging within the elongated inner elastic tubing; the conical outer connection member has an inner tapered surface and the elongated inner elastic tubing and ball are captured at the inner tapered surface; and the handle includes a handle base and a handle strap attached at ends thereof to the handle base.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 12:
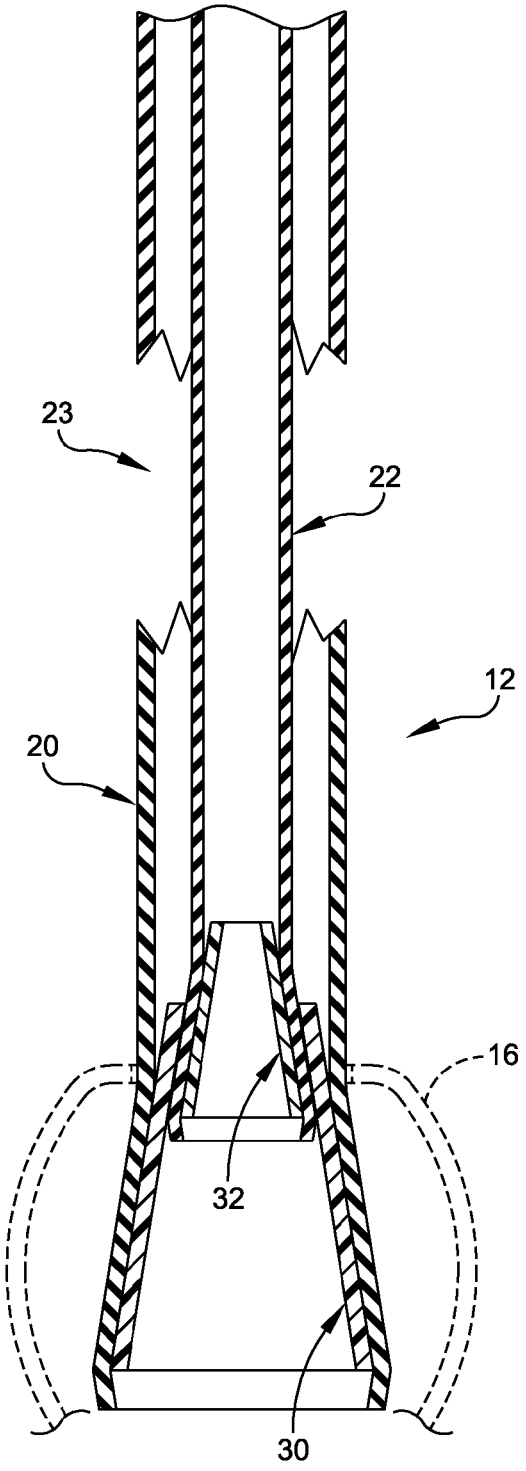
FIG. 12 is a cross-sectional view similar to that illustrated in FIG. 9 and illustrating a breaking of the outer tubing.
Figure 13:
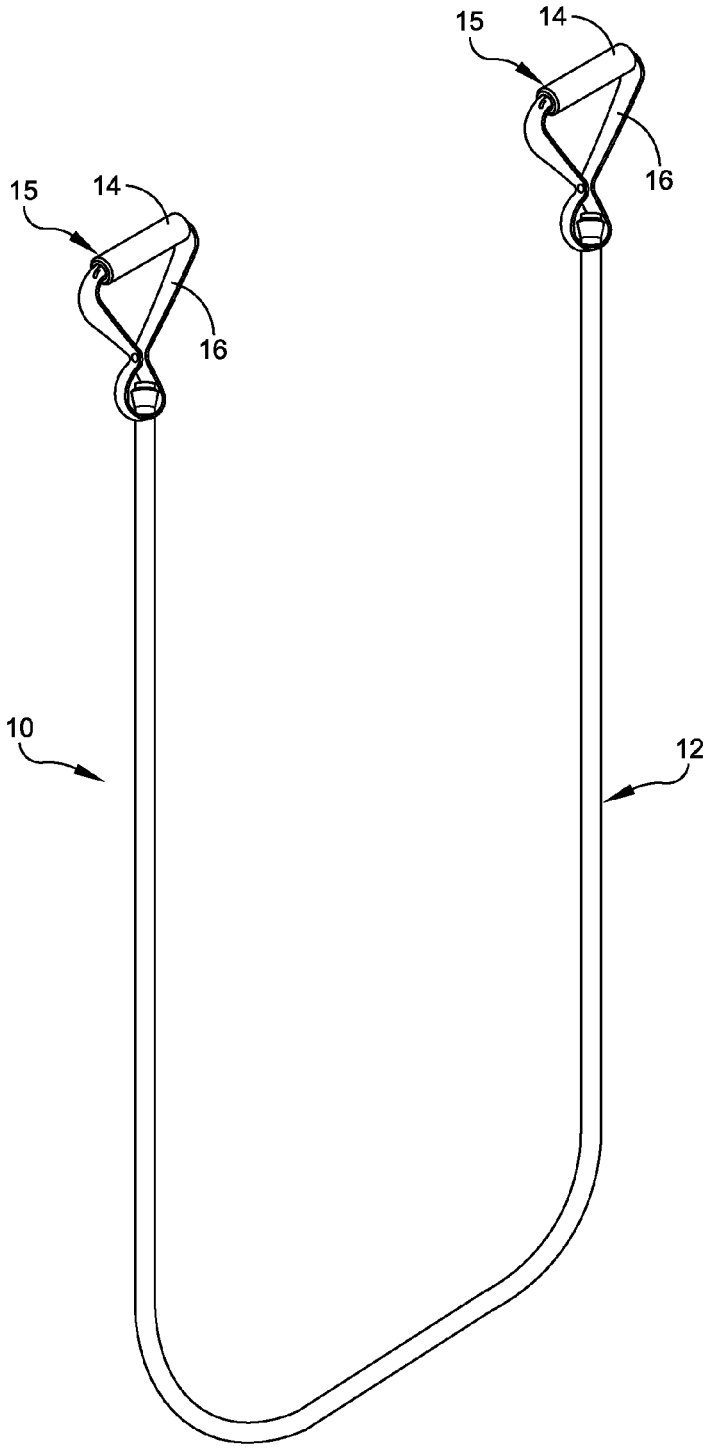
FIG. 13 is a perspective view showing the elongated flexible member with attached end handles.

Reference is now made to a first embodiment of the present invention illustrated in FIGS. 1-13. FIG. 13 actually shows a final product in the form of an exercise apparatus 10 that includes an elongated flexible member 12. Handles 14 are attached at either end of the elongated flexible member 12. Each of the handles 14 includes a cylindrical handle 15 and a strap 16. The strap 16 has a centrally disposed hole that engages about an end of the elongated flexible member.

In FIGS. 1-13, one end connection is illustrated. However, as illustrated in FIG. 13, there would be like connections at both ends of the strap. In accordance with the present invention, the exercise apparatus is comprised of multiple separate components that are assembled in a manner so as to dispose an elongated inner tubing fixed at both ends with an elongated outer tubing. The drawings illustrate an elongated outer tubing 20 and an elongated inner tubing 22. Both of these tubing pieces may have similar elongated elasticity and would be constructed of elongated flexible plastic pieces. As also illustrated in, for example, FIG. 3 there is provided an elongated outer connection member 30 and an elongated inner connection member 32 associated respectively with the outer and inner tubings. Both of the members 30 and 32 are of frusto-conic configuration as illustrated in, for example, FIGS. 3, 5 and 7.

Figure 1:
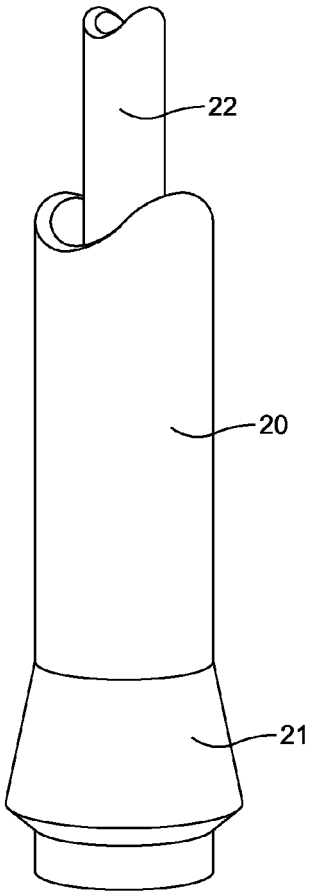
FIGS. 1 and 2 are partial end views of a portion of the exercise apparatus of the present invention.
Figure 2:
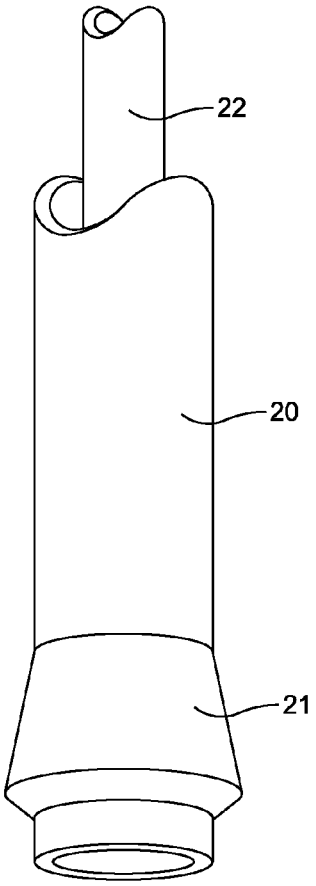
Figure 3:
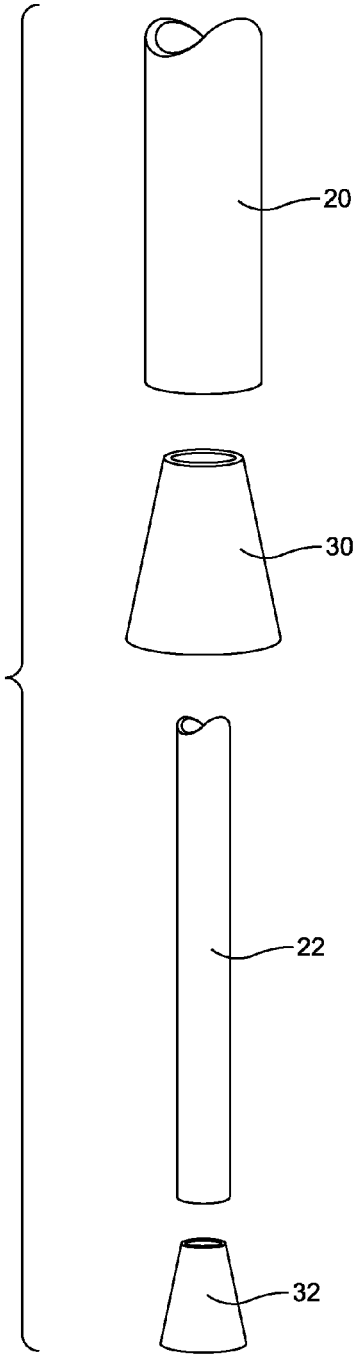
FIG. 3 is an exploded view illustrating the basic components used at one end of the band.
Figure 4:
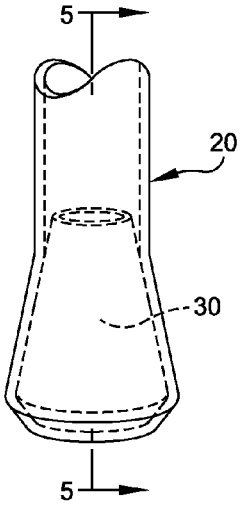
FIG. 4 is a fragmentary end view at the outer tubing.
Figure 5:
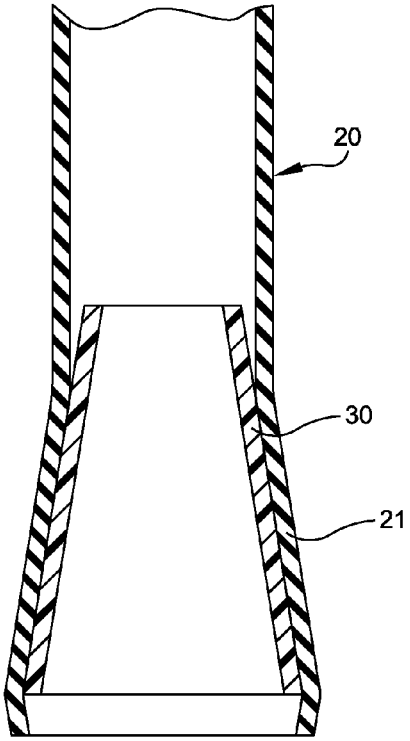
FIG. 5 is a cross-sectional view taken along line 5-5 of FIG. 4.
Figure 6:
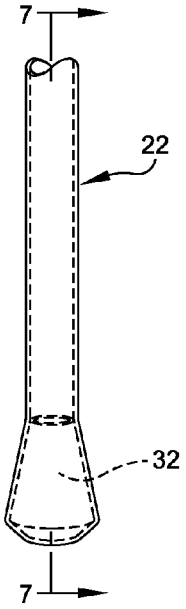
FIG. 6 is a partial end view of the inner tubing of the apparatus of the present invention.
Figure 7:
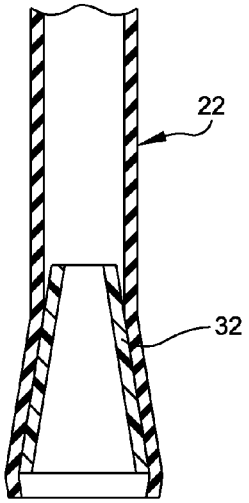
FIG. 7 is a cross-sectional view taken along line 7-7 of FIG. 6.

FIGS. 4 and 5 illustrate the conical connection member 30 as disposed within an end 21 of the elongated outer tubing 20. FIGS. 6 and 7 illustrate the inner tubing 22 and the associated inner connection member 32 disposed within an end of the elongated inner tubing 22.

Figure 8:
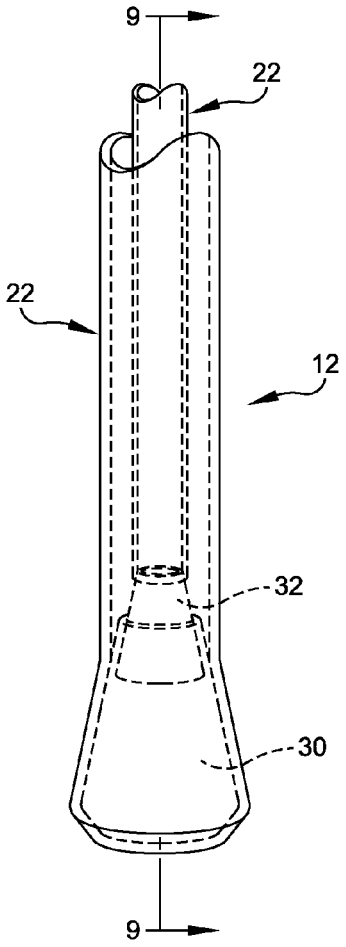
FIG. 8 is a partial end view of the assembled outer and inner tubing pieces.
Figure 9:
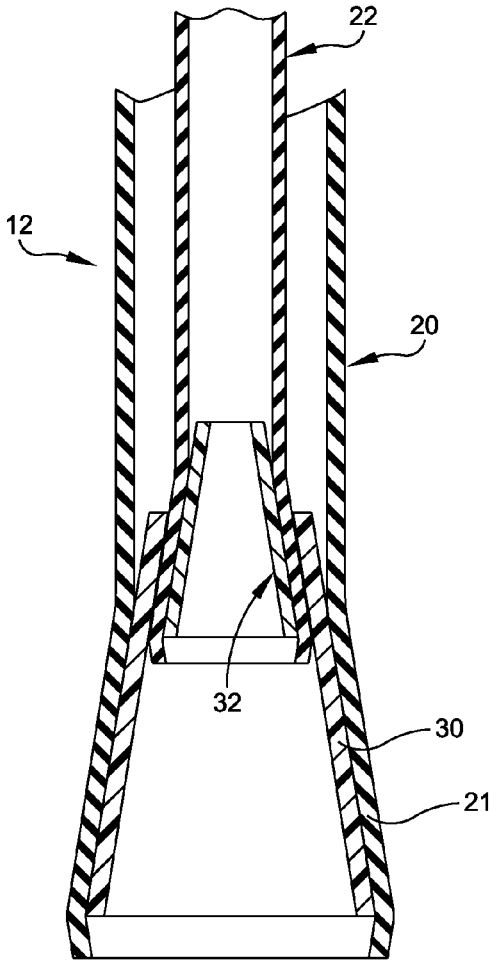
FIG. 9 is a cross-sectional view taken along line 9-9 of FIG. 8.

Reference is now made to FIGS. 8 and 9 that show the inner and outer tubing members as secured together. This is possible by the interlocking of the frusto-conic connection members 30 and 32. In the position illustrated in the cross-sectional view of FIG. 9, it is noted that the inner connection member 32 is positioned at a top end of the outer connection member 30 in a fixed position. The end of the elongated inner tubing 22 is essentially sandwiched between the connection members 30 and 32.

Figure 10:
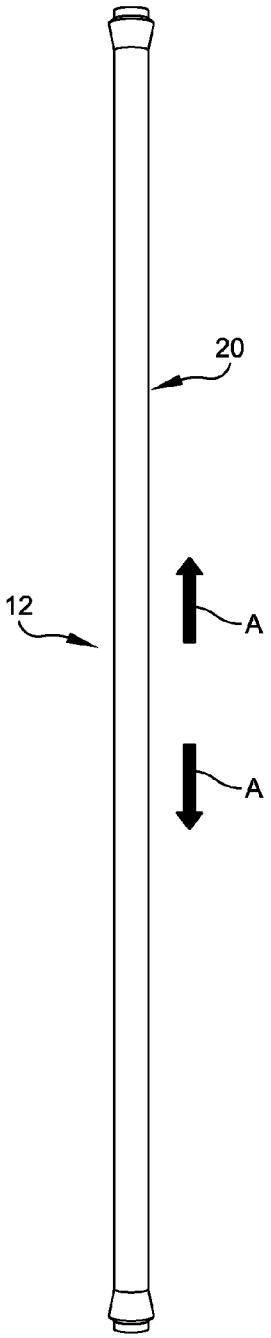
FIG. 10 illustrates one length of the band with associated end connections.
Figure 11:
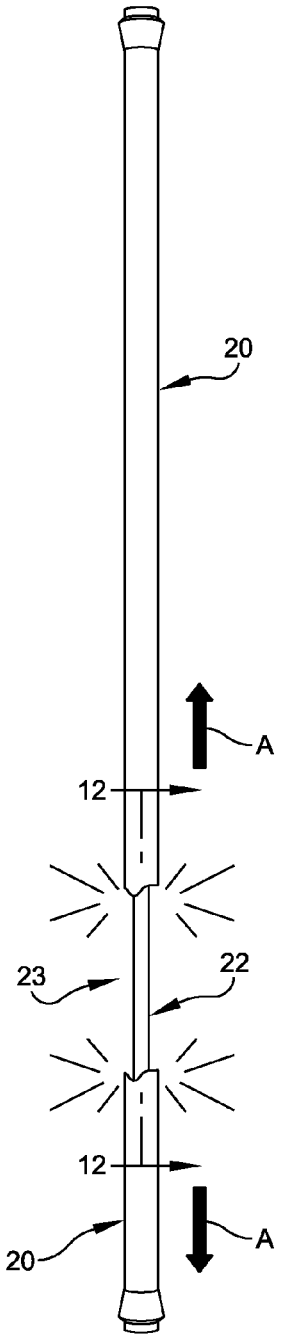
FIG. 11 is a view similar to that shown in FIG. 10 and illustrating a breaking of the outer tubing.

FIG. 10 simply illustrates the elongated flexible member 12 without any handles. The arrows A in FIGS. 10 and 11 illustrate a stretching motion that is typical with the exercise apparatus of the present invention. FIG. 11 illustrates that same motion but moreover illustrates an accidental breaking of the elongated outer tubing 20 at 23. It is noted that the elongated inner tubing 22 remains intact and thus the length of the overall exercise apparatus remains substantially the same. This action prevents any injury to the user of the apparatus. FIG. 12 also illustrates the break at 23 maintaining the inner tubing in place. In FIG. 12 the inner connection member 32 is positioned at a top end of the outer connection member 30 in a secured position. The end of the elongated inner tubing 22 is essentially sandwiched between the connection members 30 and 32. A connection such as illustrated in FIG. 12 is also provided at the opposite end of the elongated flexible member so that at both ends of the apparatus there is a secure engagement between the inner and outer tubing pieces. At each end this secure connection is formed by the respective connection members 30 and 32.

Figure 16:
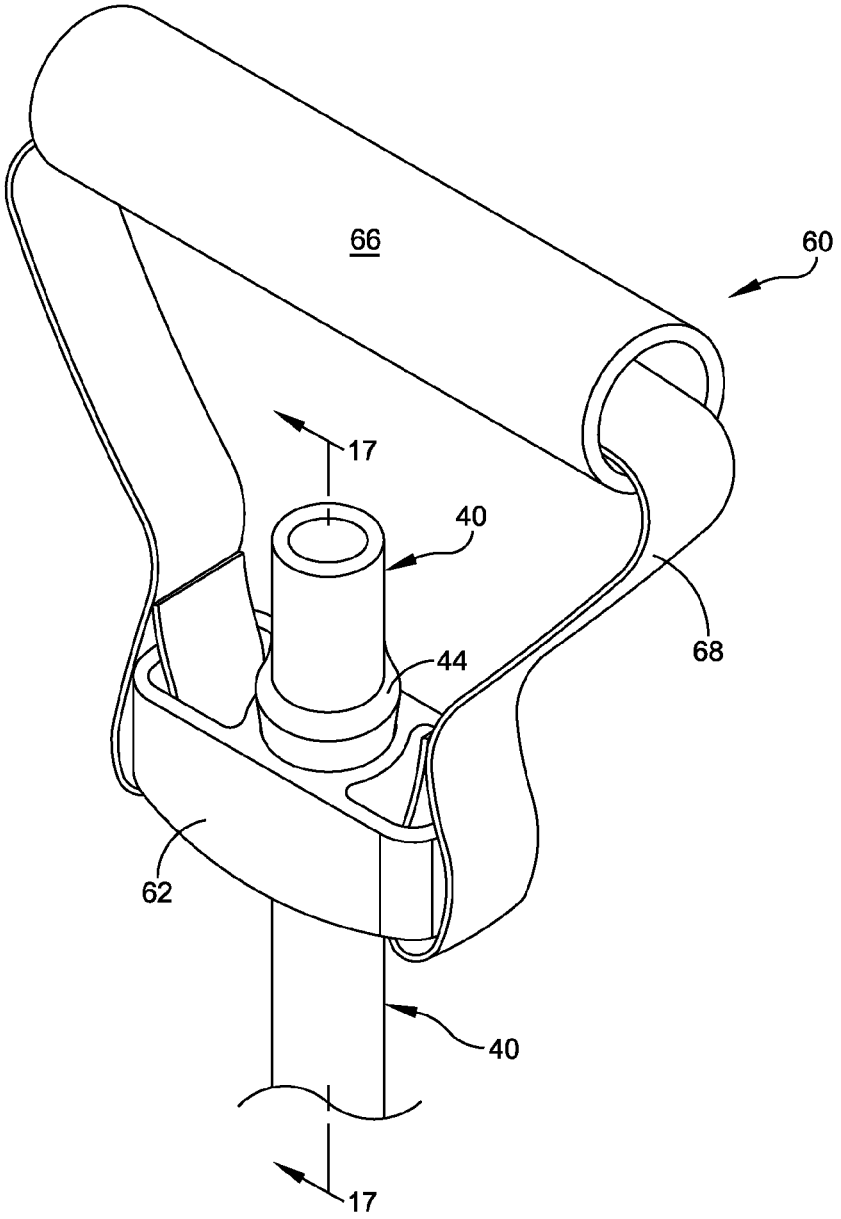
FIG. 16 is a fragmentary perspective view of the same handle end as illustrated in FIGS. 14 and 16 with the assembly to the handle completed.
Figure 17:
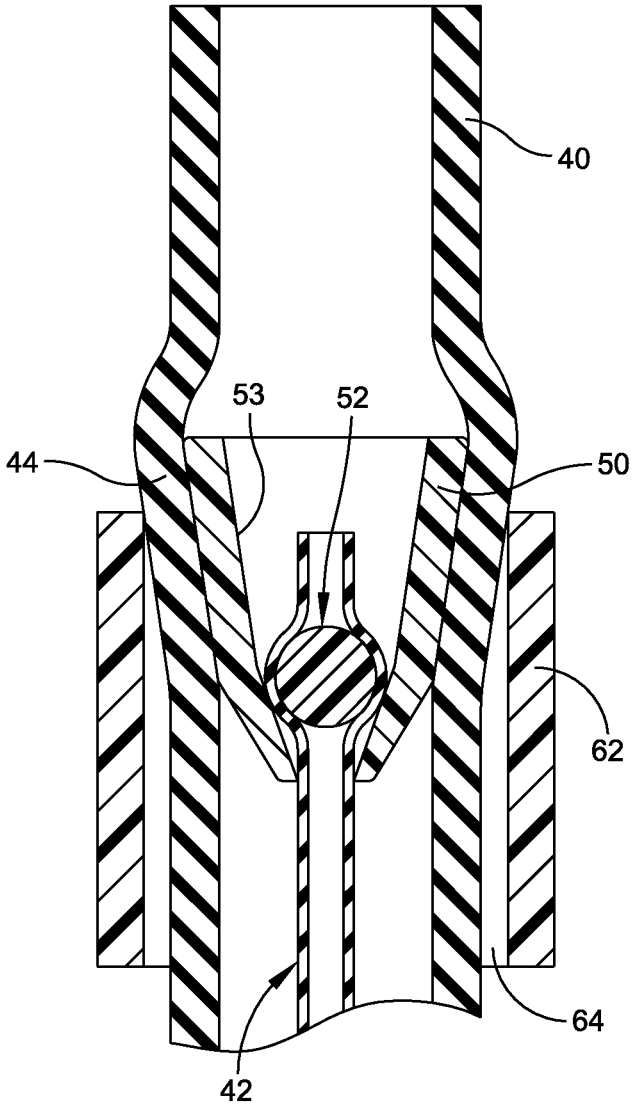
FIG. 17 is a cross-sectional view taken along line 17-17 of FIG. 16.
Figure 18:
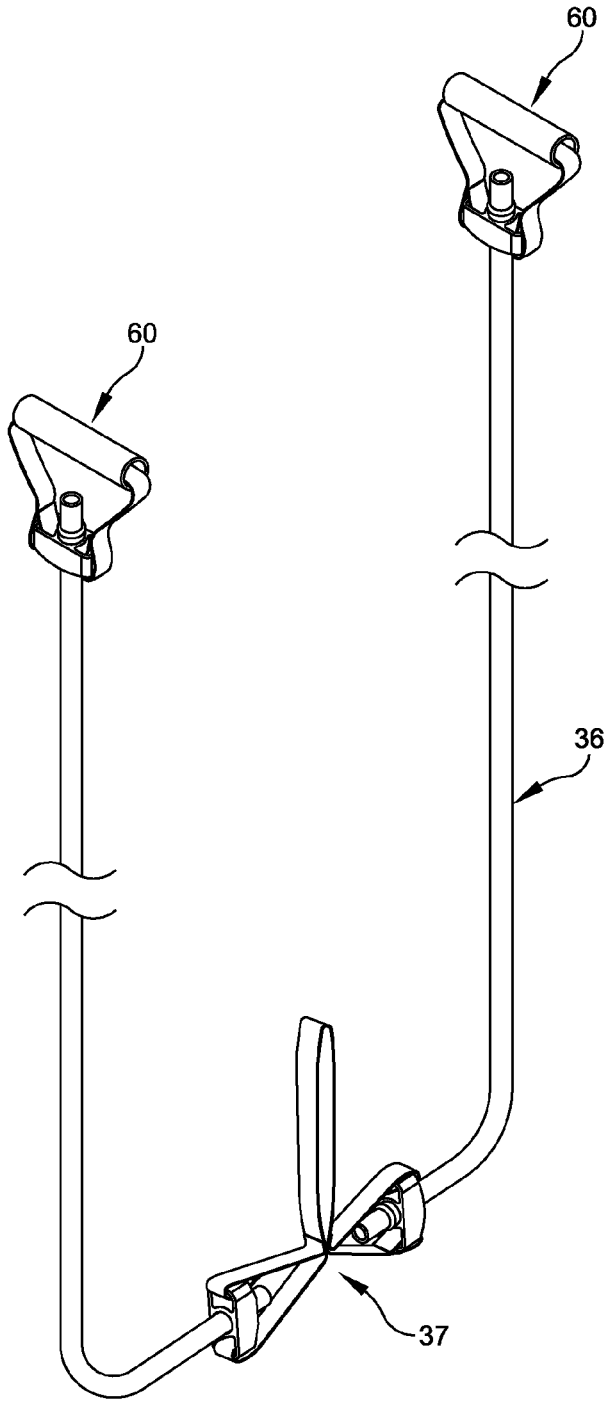
FIG. 18 illustrates an elongated flexible member with end handles and an intermediate connection member.

Reference is now made to a further embodiment of the present invention illustrated in FIGS. 14-18. FIG. 18, in particular, illustrates an elongated flexible member 36 having handles 60 at either end thereof. In this particular apparatus there is also provided an intermediate connection member 37 in the form of an integral handle structure. The intermediate connection member 37 also includes some type of a handle arrangement and thus the interconnections at that area are substantially the same as will be described in connection with FIGS. 14-17.

In FIGS. 14-17 there is illustrated an elongated outer tubing 40 and an elongated inner tubing 42. Both of these tubing pieces may have similar elongated elasticity and are constructed of an elongated flexible plastic material. There is also illustrated an outer connection member 50 and an inner connection member 52. The member 50 has a partially frusto-conic shape at a bottom end thereof. In this particular embodiment the inner connection member 52 is in the form of a ball or sphere.

Figure 14:
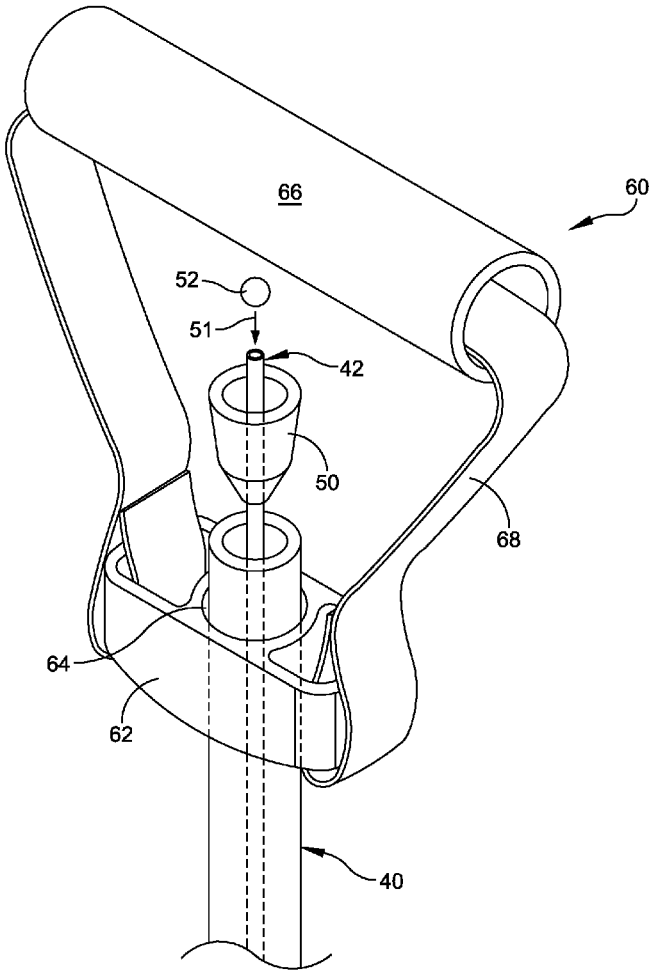
FIG. 14 is a perspective view of one end of the flexible member illustrating a handle connection.

FIG. 14 illustrates the components associated with a handle 60. The handle 60 includes a handle tube 66 and a strap 68 that has opposite ends thereof secured to the handle base 62. The handle base 62 includes a center aperture 64 through which the elongated outer tubing 40 is disposed. FIG. 14 is somewhat of an exploded view illustrating the top end of the elongated outer tubing 40 extending upwardly through the passage 64. Also illustrated in FIG. 14 is the elongated inner tubing 42. The outer connection member 50 is illustrated disposed over the top end of the elongated inner tubing. The ball 52 is illustrated suspended over the top end of the elongated inner tubing 42. The arrow 51 in FIG. 14 illustrates the ball 52 about to be moved into the tubing 42.

Figure 15:
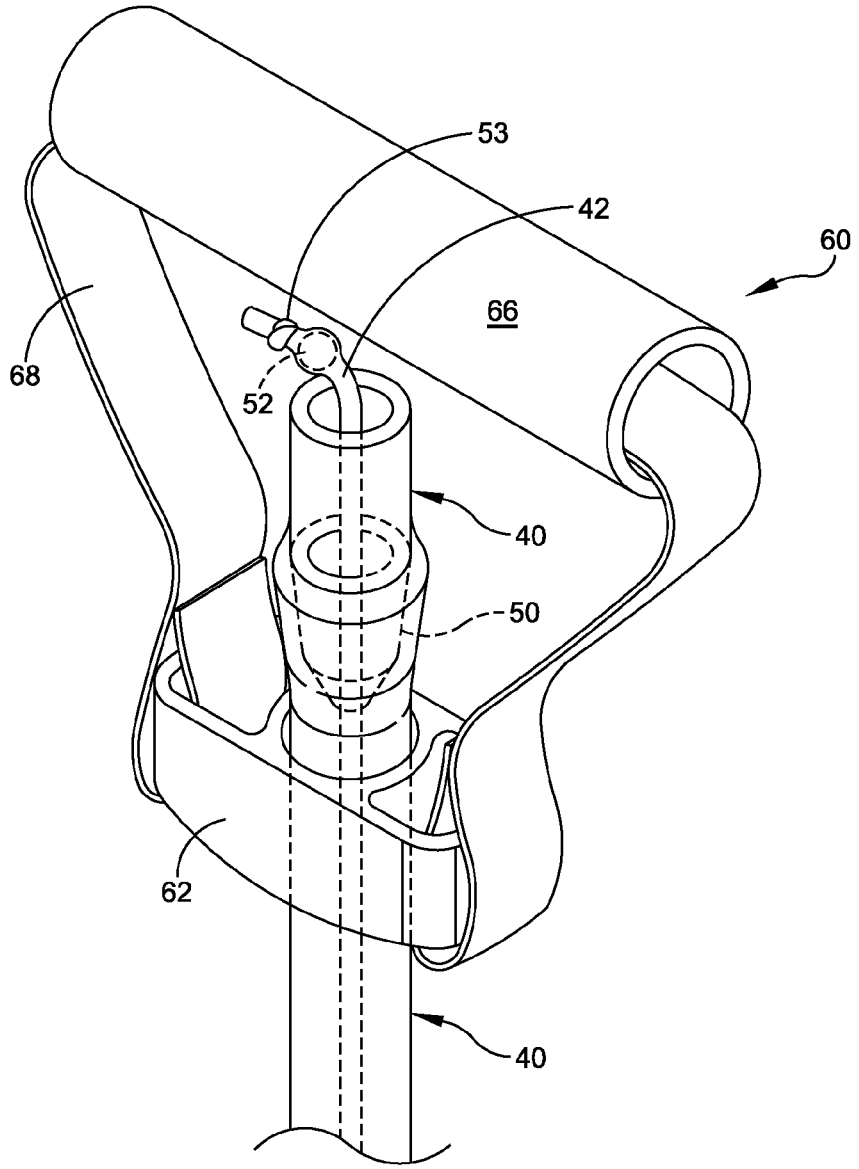
FIG. 15 is a perspective end view similar to that shown in FIG. 14 with the apparatus further assembled.

FIG. 15 is a view similar to the view of FIG. 14 but now illustrating the ball 52 disposed within the top end of the elongated inner tubing 42. FIG. 16 is a view similar to the view illustrated in FIGS. 14 and 15 and showing the components completely assembled whereby the end of the elongated outer tubing 40 is secured with the handle base 62. In this regard, refer also to the cross-sectional view of FIG. 17 taken along line 17-17 of FIG. 16. This view illustrates the final placement of the components, particularly the connection members. This arrangement causes a bulging at 44 wherein the end of the outer tubing is essentially secured with the handle base.

In the cross-sectional view of FIG. 17, the inner connection member or ball 52 is illustrated having been forced into the end of the elongated inner tubing 42. FIG. 17 illustrates the ball 52 and tubing 42 disposed at an inner tapered wall 53 of the outer connection member 50. This taper at 53 locks the elongated inner tubing relative to the elongated outer tubing. At the same time this causes a bulge in the elongated outer tubing at 44 thus firmly holding both the inner and outer tubing pieces to the handle 60.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. An exercise apparatus comprising:

an elongated outer tubing having opposed ends and that forms an outer exposed portion of the exercise apparatus;

an elongated inner tubing having opposed ends and that forms an inner hidden portion of the exercise apparatus; and a connection mechanism at each of the opposed ends for interlocking the respective opposed ends of the elongated outer tubing and the elongated inner tubing;

wherein the connection mechanism is comprised of an outer connection member engaged with an end of the elongated outer elastic tubing, and the connection mechanism is also comprised of an inner connection member engaged with an end of the elongated inner elastic tubing;

wherein both the outer connection member and the inner connection member are conical for firm engagement with the respective outer and inner elastic tubing.

2. The exercise apparatus of claim 1 wherein the elongated outer tubing comprises an elongated outer elastic tubing.

3. The exercise apparatus of claim 2 wherein the elongated inner tubing comprises an elongated inner elastic tubing.

4. The exercise apparatus of claim 3 wherein both the elongated outer elastic tubing and the elongated inner elastic tubing are hollow.

5. The exercise apparatus of claim 1 wherein the outer connection member engages an end of the elongated inner elastic tubing at a position adjacent to the inner connection member.

6. An exercise apparatus comprising:

an elongated outer tubing having opposed ends and that forms an outer exposed portion of the exercise apparatus;

an elongated inner tubing having opposed ends and that forms an inner hidden portion of the exercise apparatus; and a connection mechanism at each of the opposed ends for interlocking the respective opposed ends of the elongated outer tubing and the elongated inner tubing;

wherein the connection mechanism is comprised of an outer connection member engaged with an end of the elongated outer elastic tubing, and the connection mechanism is also comprised of an inner connection member engaged with an end of the elongated inner elastic tubing;

wherein the outer connection member is conical for firm engagement with the elongated outer elastic tubing, and the inner connection member comprises a ball engaging within the elongated inner elastic tubing.

7. The exercise apparatus of claim 6 wherein the conical outer connection member has an inner tapered surface and the elongated inner elastic tubing and ball are captured at the inner tapered surface.

8. The exercise apparatus of claim 6 in combination with a handle having a securing passage that engages the elongated outer elastic tubing.

9. An exercise apparatus comprising:

an elongated outer elastic hollow tubing having opposed ends;

an elongated inner elastic hollow tubing having opposed ends;

a connection mechanism at each of the opposed ends for interlocking the respective opposed ends of the elongated outer elastic hollow tubing and the elongated inner elastic hollow tubing; and a pair of handles positioned at respective opposed ends of the elongated outer and elongated inner elastic hollow tubings;

wherein each handle has a securing passage for receiving an end of the elongated outer elastic hollow tubing;

wherein each connection mechanism is comprised of an outer connection member engaged with an end of the elongated outer elastic hollow tubing, and an inner connection member engaged with an end of the elongated inner elastic hollow tubing;

wherein both the outer connection member and the inner connection member are conical for firm engagement with the respective outer and inner elastic tubing.

10. The exercise apparatus of claim 9 wherein the outer connection member engages an end of the elongated inner elastic tubing at a position adjacent to the inner connection member.

11. An exercise apparatus comprising:

an elongated outer elastic hollow tubing having opposed ends;

an elongated inner elastic hollow tubing having opposed ends;

a connection mechanism at each of the opposed ends for interlocking the respective opposed ends of the elongated outer elastic hollow tubing and the elongated inner elastic hollow tubing; and a pair of handles positioned at respective opposed ends of the elongated outer and elongated inner elastic hollow tubings;

wherein each handle has a securing passage for receiving an end of the elongated outer elastic hollow tubing;

wherein each connection mechanism is comprised of an outer connection member engaged with an end of the elongated outer elastic hollow tubing, and an inner connection member engaged with an end of the elongated inner elastic hollow tubing;

wherein the outer connection member is conical for firm engagement with the elongated outer elastic tubing, and the inner connection member comprises a ball engaging within the elongated inner elastic tubing.

12. The exercise apparatus of claim 11 wherein the conical outer connection member has an inner tapered surface and the elongated inner elastic tubing and ball are captured at the inner tapered surface.

13. The exercise apparatus of claim 9 wherein the handle includes a handle base and a handle strap attached at ends thereof to the handle base.

14. An exercise apparatus comprising:

an elongated outer tubing having opposed ends connecting a middle section and that forms an outer exposed portion of the exercise apparatus;

an elongated inner tubing having opposed ends connecting a middle section and that forms an inner hidden portion of the exercise apparatus; and a connection mechanism at each of the opposed ends for interlocking the respective opposed ends of the elongated outer tubing and the elongated inner tubing;

wherein the connection mechanism is comprised of an outer connection member engaged with an end of the elongated outer elastic tubing, and the connection mechanism is also comprised of an inner connection member engaged with an end of the elongated inner elastic tubing;

wherein both the outer connection member and the inner connection member have a tapered surface for firm engagement with the respective outer and inner elastic tubing;

and wherein the tapered surface extends from a smaller diameter adjacent to the middle section to a larger diameter more remote from the middle section.

15. The exercise apparatus of claim 14 wherein the elongated outer tubing comprises an elongated outer elastic tubing.

16. The exercise apparatus of claim 15 wherein the elongated inner tubing comprises an elongated inner elastic tubing.

17. The exercise apparatus of claim 16 wherein both the elongated outer elastic tubing and the elongated inner elastic tubing are hollow.

* * * * *